US007116320B2

(12) United States Patent
Hirakawa et al.

(10) Patent No.: US 7,116,320 B2
(45) Date of Patent: Oct. 3, 2006

(54) DISPLAY DEVICE, METHOD OF CONTROLLING THE SAME, AND PROJECTION-TYPE DISPLAY APPARATUS

(75) Inventors: Takashi Hirakawa, Kanagawa (JP); Masakazu Aoki, Kanagawa (JP)

(73) Assignee: Sony Corporation, Tokyo (JP)

( * ) Notice: Subject to any disclaimer, the term of this patent is extended or adjusted under 35 U.S.C. 154(b) by 328 days.

(21) Appl. No.: 10/631,568

(22) Filed: Jul. 31, 2003

(65) Prior Publication Data

US 2004/0061675 A1 Apr. 1, 2004

(30) Foreign Application Priority Data

Sep. 30, 2002 (JP) ..... P2002-286438

(51) Int. Cl.
*G09G 5/00* (2006.01)

(52) U.S. Cl. ..... 345/204; 345/87; 345/99; 327/155

(58) Field of Classification Search ..... 345/87, 345/99, 204; 327/155
See application file for complete search history.

(56) References Cited

U.S. PATENT DOCUMENTS 4,728,194 A * 3/1988 Mori et al. ..... 356/493
5,654,735 A * 8/1997 Nakajima ..... 345/99
5,886,277 A * 3/1999 Takauji ..... 84/604
5,946,279 A * 8/1999 Okada et al. ..... 369/47.45
6,076,171 A * 6/2000 Kawata ..... 713/501
6,141,032 A * 10/2000 Priest ..... 348/14.13
6,288,699 B1 * 9/2001 Kubota et al. ..... 345/99
2002/0158823 A1 * 10/2002 Zavracky et al. ..... 345/87

* cited by examiner

*Primary Examiner*—Bipin Shalwala
*Assistant Examiner*—Vincentg E. Kovalick
(74) *Attorney, Agent, or Firm*—Robert J. Depke; Rockey, Depke, Lyons & Kitzinger LLC

(57) ABSTRACT

A liquid-crystal display device performs a feedback process. A video signal is written on pixels on a unit by unit basis, each unit including a plurality of pixels (six pixels, for example). Scan pulses output from RGB LCD panels are supplied to a driver IC that supplies the RGB LCD panels with a variety of timing signals. A delay amount from the scan pulses from the optimum state thereof is measured. The delay amount is accounted for in a pulse that samples and holds the video signal, i.e., a pulsewidth control clock pulse.

8 Claims, 8 Drawing Sheets

DISPLAY DEVICE, METHOD OF CONTROLLING THE SAME, AND PROJECTION-TYPE DISPLAY APPARATUS

BACKGROUND OF THE INVENTION

1. Field of the Invention

The present invention relates to a display device, a method of controlling the display device, and a projection-type display apparatus and, in particular, to a display device which concurrently writes a video signal on a plurality of pixels at a time in a horizontal direction on a display having a matrix of pixels, a method of controlling the display device, and a projection-type display apparatus incorporating the display device.

2. Description of the Related Art

Liquid-crystal display (LCD) devices employing pixels as a display element typically use a digital signal processor IC that is manufactured using a MOS process of a gate array. After being subjected to a predetermined signal process of the digital signal processor IC, digital data is digital-to-analog converted by a digital-to-analog (D/A) converter. The resulting analog signal is then supplied to a liquid-crystal display (LCD) panel through an LCD driver. The LCD panel includes a matrix of pixels, each including a liquid crystal cell.

Since a write speed of the LCD panel is not high enough to successively write an input video signal on the dots (pixels) one by one, the video signal is typically written onto a plurality of pixels in a horizontal direction of the display at a time. In such a liquid-crystal display device of multi-pixel simultaneous writing, a sequentially and successively input video signal must be converted into a parallel signals to be written on a plurality of pixels at a time.

For example, in a liquid-crystal display device that writes the video signal on six horizontal pixels at a time, a sequentially input video signal is converted to six parallel video signals for the six respective pixels having the same timing. The six parallel video signals are then concurrently written onto six signal lines within a duration of time for the six pixels. This parallel processing is performed by an LCD driver when the video signal is subjected to a sample-and-hold process.

A sample-and-hold pulse for use in the parallel processing is generated as a timing signal in synchronization with a horizontal synchronization signal. The signal lines for conducting six-parallel video signal are physically connected to the LCD panel. A start position of the video is uniquely determined by the timing signals and a display start timing signal to the LCD panel.

The LCD panel includes signal line selection switches to select six signal lines at a time. The signal line selection switch selects six signal lines at a time to simultaneously write the video signal on the six pixels at a time. The signal line selection switches are selected in response to a switch pulse (a writing signal) successively generated in synchronization with the video signal. When the signal line selection switches are successively selected, the video signal is simultaneously conducted to the six signal lines through the selected signal selection switch.

The switch pulses and the video signal are distorted by the effect of resistances and capacitances of the signal lines that conduct these signals. An optimum display cannot be obtained without adjusting the phase relationship between the switch pulses and the video signal. An inappropriate phase relationship between the switch pulses and the video signal may leak the video signal to a location ahead of or behind the right position thereof by six pixels, thereby presenting double pictures. For example, if the phase relationship is destroyed when a single vertical line is displayed, the signal vertical line may appear on a location ahead of or behind the right location by six pixels.

Japanese Unexamined Patent Application Publication No. 2002-108299 discloses a technique which adjusts the phase relationship between a timing signal for simultaneously writing a video signal, namely, a switch pulse (writing signal) and the video signal with a precision of at least dot clock frequency without changing the center position of an image. In accordance with this conventional art, a timing generator adjusts the phase of the pulse signal serving as a reference for use in the generation of the switch pulse so that the phase relationship between the video signal and the switch pulse is adjusted without changing the center position of the image with a precision of at least the dot clock frequency.

The conventional art is effective for adjusting the phase relationship between the writing signal for simultaneously writing the video signal and the video signal on a liquid-crystal display device prior to a shipment thereof, but is ineffective for adjusting the phase relationship subsequent to the shipment. Even if an optimum adjustment is achieved prior to the shipment, the phase relationship may be destroyed due to a delay in liquid-crystal driving pulses because circuit elements are subject to temperature cycles and aging after shipment. An optimum image is not achieved.

SUMMARY OF THE INVENTION

Accordingly, it is an object of the present invention to provide a display device that constantly presents an optimum image by automatically adjusting a shift in a phase relationship due to temperature cycles and aging, a method of controlling the display device, and a projection-type display apparatus.

In one aspect of the present invention, a display device includes a display having a matrix of pixels, a phase shift detector for detecting the amount of phase shift of a writing signal for writing a video signal onto the pixel after the writing signal passes through the display, and a controller for adjusting the timing of the writing signal in a feedback process based on the phase shift amount detected by the phase shift detector so that the amount of phase shift becomes zero.

When the writing signal for writing the video signal on the pixels passes through the display, the writing signal is delayed due to degradation of circuit elements in the display as a result of temperature cycles and aging, and the phase relationship between the writing signal and the video signal is varied. The phase shift in the writing signal having passed through the display is detected, and the timing of the writing signal is adjusted based on the detected phase shift so that the phase shift amount becomes zero. A variation in the phase relationship between the writing signal and the video signal due to the phase shift is thus automatically corrected. An optimum display image is achieved without being affected by temperature cycles and aging.

DESCRIPTION OF THE PREFERRED EMBODIMENTS

Figure 1:
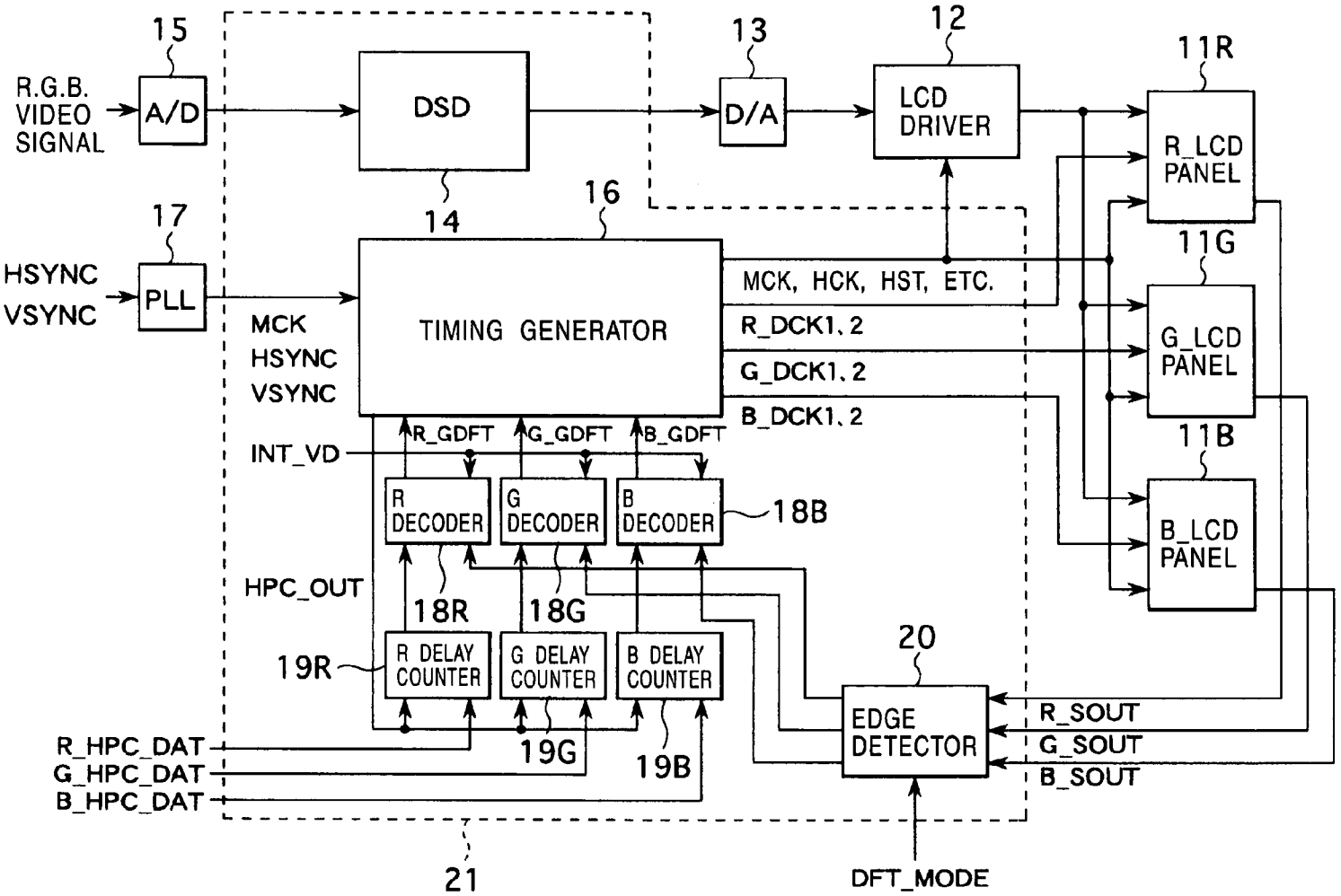
FIG. 1 is a block diagram illustrating a system of a liquid-crystal display device in accordance with one preferred embodiment of the present invention.

The preferred embodiments of the present invention are discussed with reference to the drawings. FIG. 1 is a block diagram illustrating a display device in accordance with one preferred embodiment of the present invention. The display device is a liquid-crystal display device employing liquid-crystal cells as display elements.

As shown, the liquid-crystal display device includes LCD panels 11R, 11G, and 11B for red (R), green (G), and blue (B) colors, respectively, an LCD driver 11, a D/A converter 13, a digital signal driver (DSD) 14, an A/D converter 15, a timing generator 16, a phase-locked loop (PLL) circuit 17, RGB decoders 18R, 18G, and 18B, RGB delay counters 19R, 19G, and 19B, and an edge detector 20.

A driving control circuit 21 for driving the LCD panels 11R, 11G, and 11B includes the digital signal driver 14, the timing generator 16, the RGB decoders 18R, 18G, and 18B, and the RGB delay counters 19R, 19G, and 19B, and the edge detector 20. It is assumed in this preferred embodiment that the driving control circuit 21 is implemented in one-chip IC. Hereinafter, the integrated driving control circuit 21 is referred to as a driving IC 21.

The A/D converter 15 converts R, G, and B analog video signals into digital video signals, which are then supplied to the digital signal driver 14. The digital signal driver 14 performs signal processing on the video signals, such as standard image quality adjustments including white balance adjustment and gamma correction. The D/A converter 13 converts the RGB digital video signals, which have undergone the signal processing, back into analog video signals. The analog video signals are supplied to an LCD driver 12.

The PLL circuit 17 generates a master clock MCLK, a horizontal synchronization signal HSYNC, and a vertical synchronization signal VSYNC for use in the liquid-crystal display device, in response to a horizontal synchronization signal HSYNC and a vertical synchronization signal VSYNC separated from the input analog video signals. The master clock MCLK, the horizontal synchronization signal HSYNC, and the vertical synchronization signal VSYNC are then supplied to the timing generator 16. In response to the master clock MCLK, the horizontal synchronization signal HSYNC, and the vertical synchronization signal VSYNC supplied from the PLL circuit 17, the timing generator 16 generates a variety of timing signals including a master clock MCK, a horizontal clock pulse HCK, and a horizontal start pulse HST.

The master clock MCK, the horizontal clock pulse HCK, and the horizontal start pulse HST, generated by the timing generator 16, are commonly supplied to the LCD panels 11R, 11G, and 11B. The timing generator 16 further generates pulsewidth control clock pulses DCK1 and DKC2 for each of the R, G, and B colors. These pulsewidth control clock pulses DCK are supplied to the respective LCD panels 11R, 11G, and 11B.

The LCD driver 12 performs an amplification process, a 1H (H stands for horizontal scanning period) inverting process, and a sample-and-hold process on the RGB analog video signals supplied from the D/A converter 13, and then supplies the LCD panels 11R, 11G, and 11B with the resulting analog signals for presentation. When the LCD driver 12 performs the sample-and-hold process, the LCD driver 12 also performs a parallel process for converting a sequentially input analog video signal into parallel signals in units of a plurality of pixels, for example, six pixels to write the video signal on six pixels at a time in each of the LCD panels 11R, 11G, and 11B. The pulsewidth control clock pulses DCK are used in the parallel process as the sample-and-hold pulse.

The structure and function of the RGB decoders 18R, 18G, and 18B, the RGB delay counters 19R, 19G, and 19B, the edge detector 20, and the timing generator 16 in the driving IC 21 will be discussed in detail later.

The RGB decoders 18R, 18G, and 18B, the RGB delay counters 19R, 19G, and 19B, and the edge detector 20 form phase shift detector that detects a phase shift amount of a each of the writing signal, namely, switch pulses SPLS1, SPLS2, . . . with respect to the video signal written onto the pixels 31, the phase shift of the writing signal taking place as a result of the passage thereof through the LCD panels 11R, 11G, and 11B.

A portion of an internal circuit of the timing generator 16 forms a controller which adjusts the timing of the switch pulses SPLS1, SPLS2, . . . in a feedback process in response to the detected phase shift amount so that the phase shift amount becomes zero, in other words, the controller which adjusts the timing of the pulsewidth control clock pulses DCK for generating the switch pulses SPLS1, SPLS2, . . .

Figure 2:
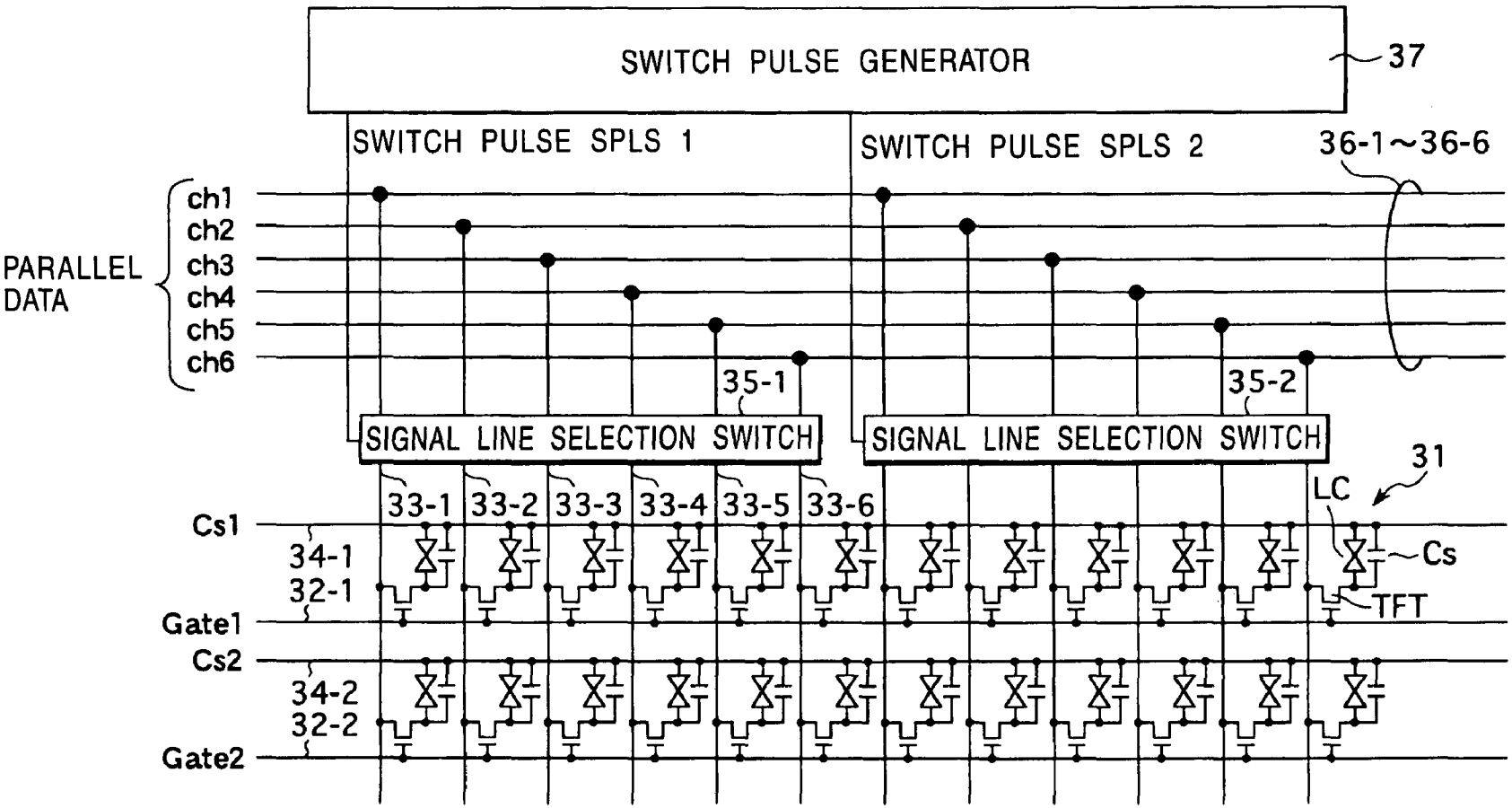
FIG. 2 is a circuit diagram of an internal structure of an LCD panel.

FIG. 2 is a circuit diagram of the internal structure of the LCD panels 11R, 11G, and 11G. As shown, a display area (display) includes a matrix of unit pixels 31, each including a thin-film transistor (TFT) as a pixel transistor, a cell liquid crystal (LC), and a storage capacitor. Vertical scanning lines 32-1, 32-2, . . . are arranged for respective rows of pixels, and signal lines 33-1, 33-2, . . . are arranged for respective columns of pixels.

In the pixel structure, the TFTs are configured with the gates thereof connected to the respective vertical scanning lines 32-1, 32-2, . . . and the sources thereof connected to the respective signal lines 33-1, 33-2, . . . The cell LCs are configured with pixel electrodes thereof connected to the respective drains of the TFTs, and counter electrodes thereof connected to common lines 34-1, 34-2, . . . The cell LC is a capacitance formed between the pixel electrode of the TFT and the counter electrode formed to be opposed to the pixel electrode. The storage capacitor is provided between the drain of the TFT and each of the common electrode lines 34-1, 34-2, . . .

The liquid-crystal display device of this embodiment adopts a six pixel simultaneous writing method, in which the video signal is written onto six pixels at a time. Each of signal line selection switches 35-1, 35-2, . . . is connected to respective group of six signal lines 33-1, 33-2, . . . The six outputs of the signal selection switch 35-1 are respectively supplied to ends of the signal lines 33-1, 33-2, . . . , the six outputs of the signal selection switch 35-2 are respectively supplied to ends of the signal lines 33-7, 33-8, . . . , and so on.

Six input terminals of each of the signal line selection switches 35-1, 35-2, . . . are respectively connected to six data lines 36-1, . . . , 36-6. Through the data lines 36-1, . . . , 36-6, each of the signal line selection switches 35-1, 35-2, . . . receives, at the six input terminals thereof, parallel video signals ch1–ch6 for six pixels obtained in the sample-and-hold process of the LCD driver 12.

The signal line selection switches 35-1, 35-2, . . . respectively receive the switch pulses SPLS1, SPLS2, . . . from a switch pulse generator 37 as a writing signal for writing the video signal onto the pixel 31. The six parallel signals ch1–ch6 input through the data lines 36-1, . . . , 36-6 are written on the signal lines 33-1, 33-2, . . . through the signal line selection switches 35-1, 35-2, . . . The video signal is simultaneously written onto cell LCs and storage capacitors Cs in the pixels 31 respectively connected to the vertical scanning lines 32-1, 32-2, . . . of the row driven by gate selection pulses (vertical scanning pulses) Gate 1, Gate 2, . . . on six pixels at a time.

Figure 3:
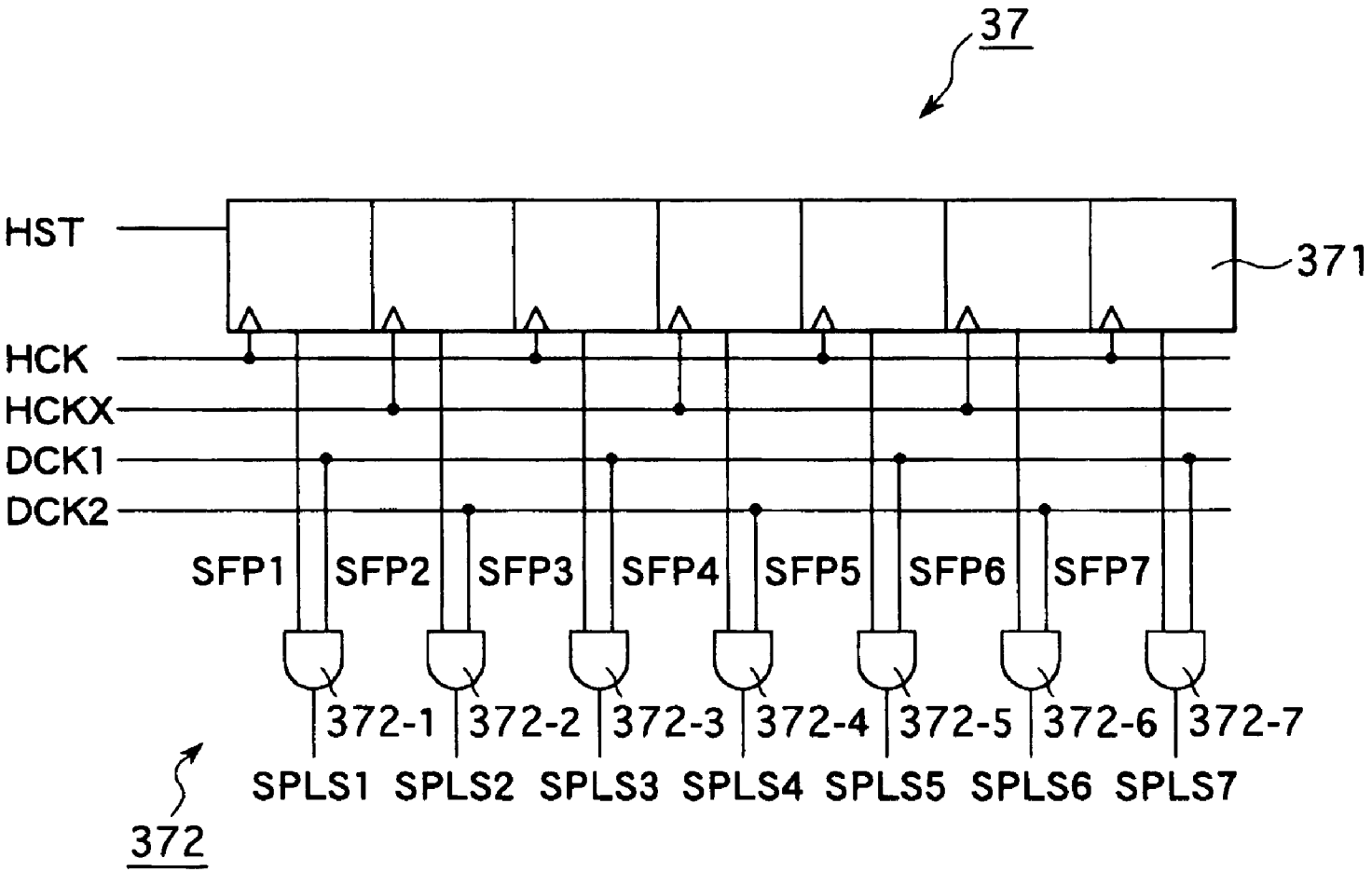
FIG. 3 is a block diagram illustrating the structure of a switch pulse generator.

FIG. 3 is a block diagram illustrating the structure of the switch pulse generator 37. As shown, the switch pulse generator 37 includes a shift register 371 and a group of AND gates 372. The switch pulse generator 37 receives the horizontal start pulse HST, the horizontal clock pulse HCK and the inverted version thereof HCKX, and the pulsewidth control clock pulses DCK 1 and DCK2, generated by the timing generator 16 (see FIG. 1).

For simplicity of drawing, the shift register 371 has seven stages. In practice, the shift register 371 has stages of the number corresponding to the number of pixels in the horizontal direction of the display area of a matrix of pixels 31. Let m represent the number of pixels in the horizontal direction, and the shift register 371 has m stages.

The shift register 371 in the switch pulse generator 37 received the horizontal start pulse HST while also receiving the horizontal clock pulses HCK and HCKX alternately every state. Upon receiving the horizontal start pulse HST, the shift register 371 starts a shift operation thereof. The shift register 371 shifts the horizontal start pulse HST in synchronization with the horizontal clock pulses HCK and HCKX, thereby outputting shift pulses SFP1, SFP2, . . . from respective stages.

The shift pulses SFP1, SFP2, . . . are supplied to input terminals of the respective AND gates 372-1, 372-2, . . . in the AND gate group 372. The pulsewidth control clock pulses DCK1 and DCK2 are alternately supplied to the other input terminals of the AND gates 372-1, 372-2, . . . The AND gates 372-1, 372-2, . . . AND-gate respectively the shift pulses SFP1, SFP2, . . . and alternate one of the pulsewidth control clock pulses DCK1 and DCK2, thereby generating the switch pulses SPLS1, SPLS2, . . . to be fed to the signal line selection switches 35-1, 35-2, . . . as shown in FIG. 2, respectively.

Figure 4:
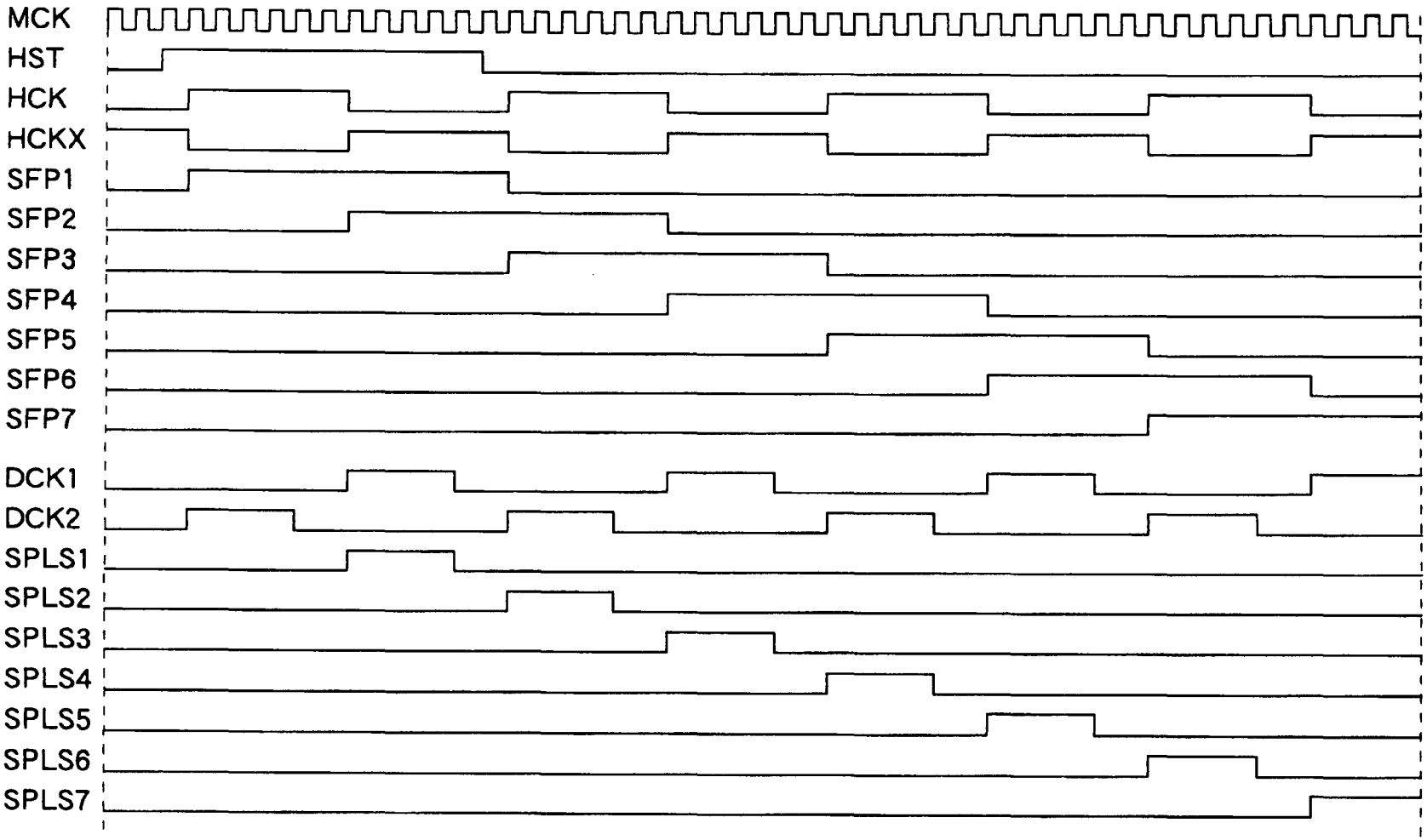
FIG. 4 is a timing diagram illustrating the relationship of a master clock, a horizontal start pulse, horizontal clock pulses, shift pulses, pulsewidth control clock pulses, and switch pulses.

FIG. 4 is a timing diagram illustrating the relationship of the master clock MCK, the horizontal start pulse HST, the horizontal clock pulses HCK and HCKX, the shift pulses SFP1, SFP2, . . . , the pulsewidth control clock pulses DCK1 and DCK2, and the switch pulses SPLS1, SPLS2, . . .

As shown, the pulsewidth control clock pulses DCK1 and DCK2 are shifted from each other in phase by half the period thereof, and have a pulsewidth shorter than half the period thereof. When the switch pulses SPLS1, SPLS2, . . . are generated, the pulsewidths of the switch pulses SPLS1, SPLS2, . . . are controlled so that the falling edge of one switch pulse is spaced apart from the rising edge of a next switch pulse by an appropriate interval. The switch pulses SPLS1, SPLS2, . . . are thus prevented from overlapping each other in time.

Shift pulses SFPm (shift pulses SFP7 here) output from the final m-th stages of the shift registers 371 in the LCD panels 11R, 11G, and 11B are output as scan pulses R_SOUT, G_SOUT, and B_SOUT. The scan pulses R_SOUT, G_SOUT, and B_SOUT are supplied to the edge detector 20 in the driving IC 21 (see FIG. 1).

The scan pulses R_SOUT, G_SOUT, and B_SOUT are delayed in the output timing thereof from the final m-th stages of the shift registers 371 if the circuit elements such as transistors forming the shift register 371 are degraded in performance due to temperature cycles and aging. Since the degradation of the circuit elements vary among the LCD panels 11R, 11G, and 11B, the delays in the scan pulses R_SOUT, G_SOUT, and B_SOUT are different among the LCD panels 11R, 11G, and 11B.

Returning to FIG. 1, the edge detector 20 detects at least one of the falling edge and the rising edge of each of the scan pulses R_SOUT, G_SOUT, and B_SOUT, which serve as a reference of the switch pulses SPLS1, SPLS2, . . . as the writing signal for writing the video signal onto the pixels. Here in this preferred embodiment, the edge detector 20 detects both the falling edge and the rising edge of each of the scan pulses R_SOUT, G_SOUT, and B_SOUT.

Figure 5:
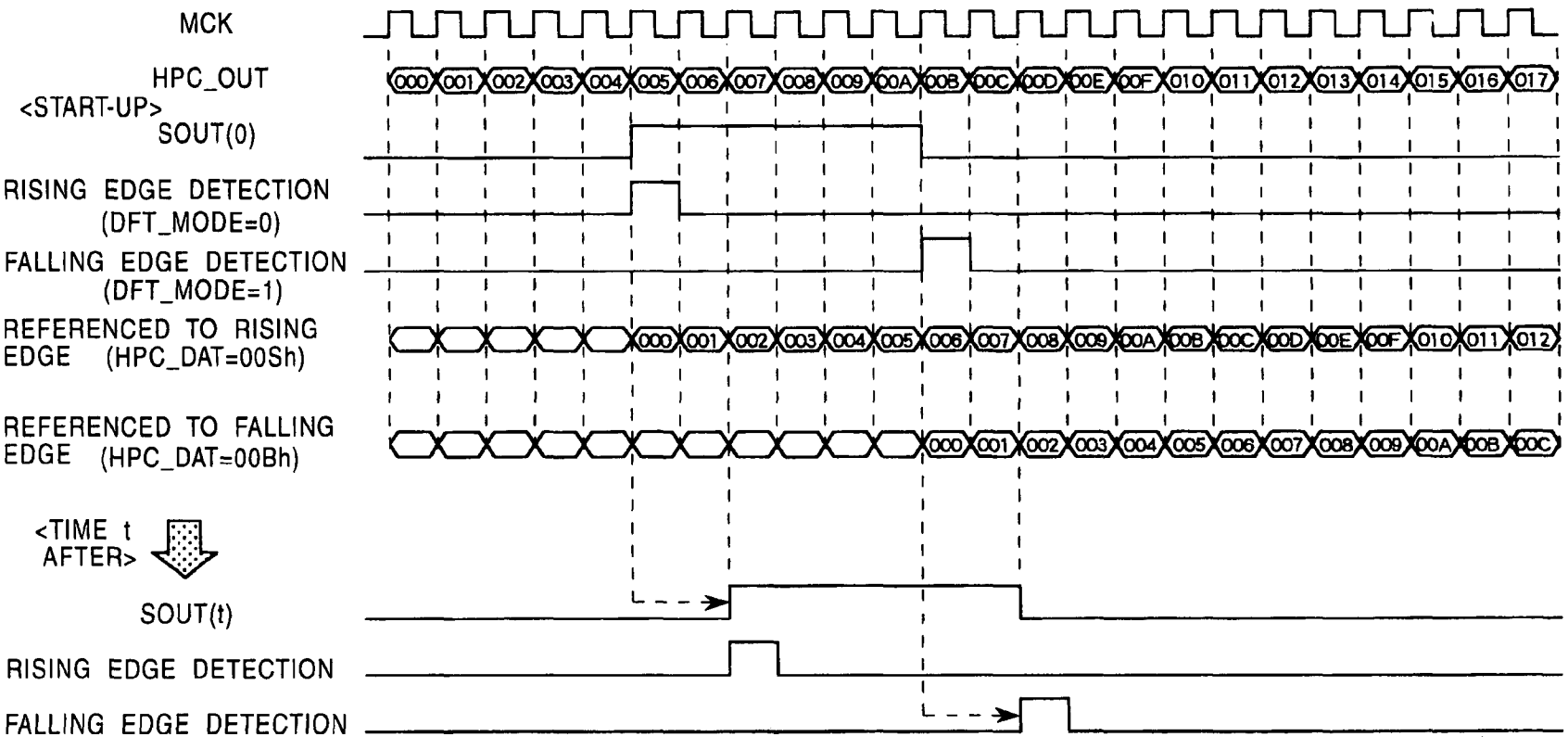
FIG. 5 is a timing diagram illustrating a circuit operation of an edge detector.

As shown in a timing diagram in FIG. 5, the edge detector 20 generates a detected pulse having a pulsewidth equal to one period of the master clock MCK by detecting both the falling edge and the rising edge of each of the scan pulses R_SOUT, G_SOUT, and B_SOUT. Rather than always outputting the detected pulses responsive to both the falling edge and the rising edge, the edge detector 20 outputs the detected pulse responsive to the rising edge or the detected pulse responsive to the falling edge depending on a mode signal DFT_MODE provided by a CPU (not shown) controlling the entire system. For example, the edge detector 20 outputs the detected pulse responsive to the rising edge if the mode signal DFT_MODE is at a logical "0", or the detected pulse responsive to the falling edge if the mode signal DFT_MODE is a logical "1".

Depending on the mode signal DFT_MODE, the edge detector 20 selects one of the rising edge and the falling edge of each of the scan pulses R_SOUT, G_SOUT, and B_SOUT. Upon detecting the one of the rising edge and the falling edge, the edge detector 20 outputs the detected pulse. The detected pulses are supplied to the RGB decoders 18R, 18G, and 18B for decoding the counts of the RGB delay counters 19R, 19G, and 19B as a decoding pulse.

The RGB delay counters 19R, 19G, and 19B are provided to determine the delay amounts of the scan pulses R_SOUT, G_SOUT, and B_SOUT. More specifically, the RGB delay counters 19R, 19G, and 19B determines the delay amounts by counting horizontal position data HPC_OUT output from the timing generator 16. The horizontal position data HPC_OUT will be discussed later.

The RGB delay counters 19R, 19G, and 19B are supplied with reset data HPC_DAT for setting the reset position (timing) thereof by the CPU on a per RGB basis. By changing the values of the reset data HPC_DAT, the reset positions of the RGB delay counters 19R, 19G, and 19B are set to desired values. Referring to the timing diagram shown in FIG. 5, the positions of the decoding pulses of the RGB decoders 18R, 18G, and 18B at the startup phase are set to the reset positions of the RGB delay counters 19R, 19G, and 19B, and the counts of the RGB delay counters 19R, 19G, and 19B become directly the delay amounts.

The counts of the RGB delay counters 19R, 19G, and 19B are decoded into delay amounts RGB GDFT (namely, R_GDFT, G_GDFT, and B_GDFT) by the RGB decoders 18R, 18G, and 18B, respectively. The delay amounts RGB GDFT are then supplied to the timing generator 16. As already discussed, the timing generator 16 generates a variety of timing signals. The specific circuit arrangement of the timing generator 16 generating the horizontal clock pulse HCK and the pulsewidth control clock pulse DCK is discussed here.

Figure 6:
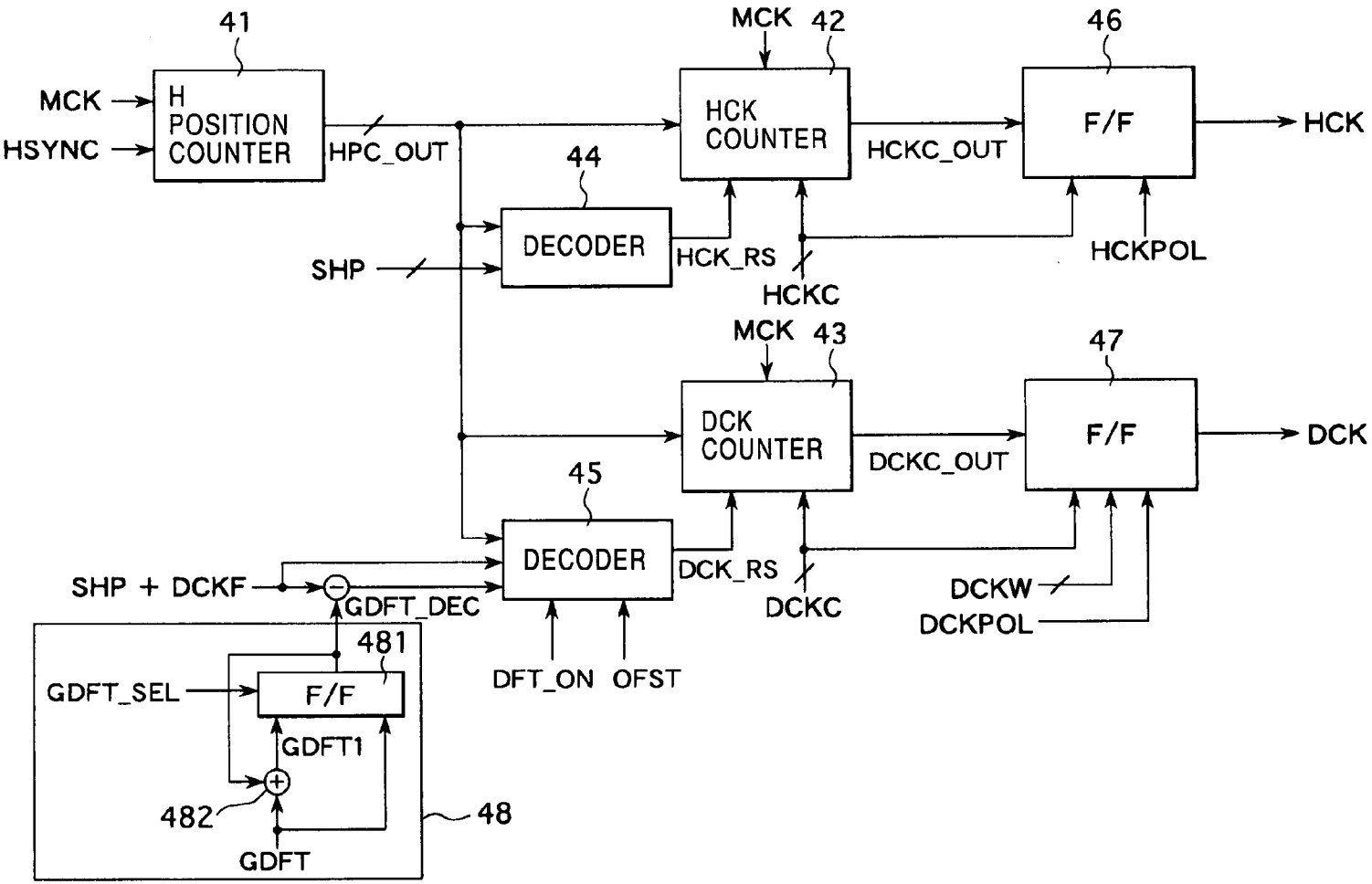
FIG. 6 is a block diagram illustrating a pulse generator.

FIG. 6 is a block diagram illustrating a circuit for generating the horizontal clock pulse HCK and the pulsewidth control clock pulse DCK (hereinafter referred to as an "HCK and DCK pulse generator"). The HCK and DCK pulse generator constitutes a controller which adjusts the timing of the pulsewidth control clock pulse DCK in response to the delay amount (a phase shift) GDFT detected by the driving IC 21 in a feedback process so that the delay amount becomes zero. The HCK and DCK pulse generators are respectively arranged for the LCD panels 11R, 11G, and 11B (see FIG. 1).

As shown in FIG. 6, the HCK and DCK pulse generator includes a H (horizontal) position counter 41, an HCK counter 42, a DCK counter 43, decoders 44 and 45, flipflops (F/Fs) 46 and 47, and a feedback processing block 48.

After being reset by the horizontal synchronization signal HSYNC, the H position counter 41 is incremented in synchronization with the master clock MCK, and outputs the count as the horizontal position data HPC_OUT every 1H (H represents the horizontal scanning period) indicating a position in the horizontal direction of the display. The horizontal position data HPC_OUT is supplied to each of the HCK counter 42, the DCK counter 43, and the decoders 44 and 45.

The decoder 44 outputs a reset pulse HCK_RS that remains at a high level only when the horizontal position data HPC_OUT is a register value SHP. The register value SHP determines a start position of the horizontal clock pulse HCK within the 1H. The reset pulse HCK_RS is supplied to the HCK counter 42.

After being reset by the reset pulse HCK_RS, the HCK counter 42 is incremented in synchronization with the master clock MCK. When the count of the HCK counter 42, namely, HCKC_OUT is a register value HCKC, the HCK counter 42 is reset again. The register value HCKC is used to set the period of the horizontal clock pulse HCK. The count HCKC_OUT of the HCK counter 42 is supplied to the flipflop 46.

The flipflop 46 outputs a polarity set by a polarity setting value HCKPOL. By reversing the polarity of the polarity setting value HCKPOL every half the period, namely, {(HCKC+1)/2}, the flipflop 46 generates a pulse having a duty factor of 50%. The horizontal clock pulse HCK, which is the output of the flipflop 46, becomes a clock pulse having the period of (HCKC+1) and a duty factor of 50% with respect to the position of the reset pulse HCK_RS generated by the decoder 44.

The decoder 45 generates a reset pulse DCK_RS of the DCK counter 43 by decoding the value of the horizontal position data HPC_OUT output by the H position counter 41. After being reset by the reset pulse DCK_RS, the DCK counter 43 is incremented in synchronization with the master clock MCK. The DCK counter 43 is reset again when the count DCKC_OUT thereof becomes the register value DCKC. The register value DCKC is used to set the period of the pulsewidth control clock pulse DCK. The count DCKC_OUT of the DCK counter 43 is supplied to the flipflop 47.

The flipflop 47 outputs a polarity set by a polarity setting value DCKPOL. When the count DCKC_OUT becomes a register value DCKW, the flipflop 47 reverses and then holds the polarity setting value DCKPOL. When the count DCKC_OUT becomes the register value DCKW, the flipflop 47 sets the polarity setting value DCKPOL again. The flipflop 47 thus generates a pulse having a pulsewidth of (DCKW+1) and a period of (DCKC+1). Then, the relationship of DCKW<DCKC must hold. The pulsewidth control clock pulse DCK, which is the output of the flipflop 47, becomes a clock pulse having the pulsewidth of (DCKW+1) and the period of (DCKC+1) with respect to the position of the reset pulse DCK_RS generated by the decoder 45.

The decoder 45 is supplied with a register value DFT_ON setting the on and off of a drift process to be discussed later, and a register value OFST indicating an offset value to be discussed later. It is now assumed that the drift process is turned off when the register value DFT_ON is a logical "0", and that the drift process is turned on when the register value DFT_ON is a logical "1". When the drift process is turned off, the decoder 45 generates the reset pulse DCK_RS that remains high in level only when the horizontal position data HPC_OUT is (SHP+DCKF). The register DCKF is used to set a phase difference of the pulsewidth control clock pulse DCK with respect to the horizontal clock pulse HCK.

When the drift process is turned on, the decoder 45 generates the reset pulse DCK_RS that remains high in level only when the value of the horizontal position data HPC_OUT is (SHP+DCKF−DCKF_DEC+OFST). The DCKF_DEC is an output value of the feedback processing block 48. The register value OFST is effective only when the register value DFT_ON is a logical "1", in other words, when the drift process is on.

This is intended to give an offset value indicated by the register value OFST so that the reset position may not take a value ahead of 000h of the horizontal position data HPC_OUT in the feedback process to be discussed later. The reset position of the pulsewidth control clock pulse DCK fed back is offset beforehand in the feedback process so that the reset operation is reliably performed.

The feedback processing block 48 will now be discussed. As seen from FIG. 6, the feedback processing block 48 includes a flipflop 481 and an adder 482. The feedback processing block 48 receives the delay amounts GDFT (R_GDFT, G_GDFT, and B_GDFT) from the LCD panels 11R, 11G, and 11B (see FIG. 1).

The scan pulses R_SOUT, G_SOUT, and B_SOUT output from the LCD panels 11R, 11G, and 11B may or may not move forward in time axis in the feedback process. The feedback processing block 48 performs different processes depending on whether or not the scan pulses R_SOUT, G_SOUT, and B_SOUT move forward in time. The feedback process here refers to an operation to reflect, in the reset position of the DCK counter 43, the delay amount GDFT based on the scan pulses.

The scan pulses SOUT do not move forward in time in the specification of the liquid-crystal display device of this preferred embodiment where the switch pulse generator 37 (see FIG. 3) in each of the LCD panels 11R, 11G, and 11B performs a shift operation in synchronization with the horizontal clock pulse HCK. A register value GDFT_SEL is set to be a logical "0". In the LCD panel of this specification, the pulsewidth control clock pulse DCK is also used as already discussed. The scan pulses SOUT move forward in the specification of the liquid-crystal display device where the switch pulse generator 37 performs a shift operation in synchronization with the pulsewidth control clock pulse DCK. The register value GDFT_SEL is set to be a logical "1". In the LCD panel of this specification, the horizontal clock pulse HCK is not used.

When the scan pulses SOUT do not move forward, the values decoded by the RGB decoders 18R, 18G, and 18B become directly the delay amounts. The flipflop 481 receives the register value GDFT_SEL of a logical "0", thereby outputting the delay amounts GDFT supplied from each of the RGB decoders 18R, 18G, and 18B as output values DCKF_DEC of the feedback processing block 48.

If the feedback process is performed on the delay amount GDFT after a first decoding operation of the RGB decoders 18R, 18G, and 18B, the value to be decoded by the RGB decoders 18R, 18G, and 18B next becomes "0". Then, if a process similar to the process in which the scan pulses do not move forward is performed, the feedback processing block 48 reverts back to a post-feedback process state or a pre-feedback process state.

If the scan pulses SOUT move forward, the flipflop 481 holds the delay amount GDFT that is obtained first by the RGB decoders 18R, 18G, and 18B, and the adder 482 adds the held delay amount GDFT and next delay amount GDFT, thereby determining a delay amount GDFT1 from startup. The delay amount GDFT1 is output as the output DCKF_DEC of the feedback processing block 48.

The function of the feedback processing block 48 described above is summarized as below. If the scan pulse SOUT is not fed back through the feedback process, the values GDFT, into which the RGB decoders 18R, 18G, and 18B decode the counts of the RGB delay counters 19R, 19G, and 19B, are used as feedback amounts. If the scan pulses SOUT itself is fed back, the sum of the decoded value GDFT and next decoded value GDFT is used as a feedback amount.

For example, it is now assumed that decode pulses (detected pulses) generated by the edge detector 20 at the startup phase are set to take 000h in each of the RGB delay counters 19R, 19G, and 19B, and that the pulsewidth control clock pulse DCK suffers from a delay of two clocks (2CLKs) of the master clock MCK because of temperature cycles and aging. If the scan pulse SOUT itself is not fed back, the position of the decode pulse is set at a position of 002h in each of the RGB delay counters 19R, 19G, and 19B in the feedback operation as shown in a timing diagram shown in FIG. 7. The decode pulse position is thus shifted forward by the count from the reset position.

Figure 7:
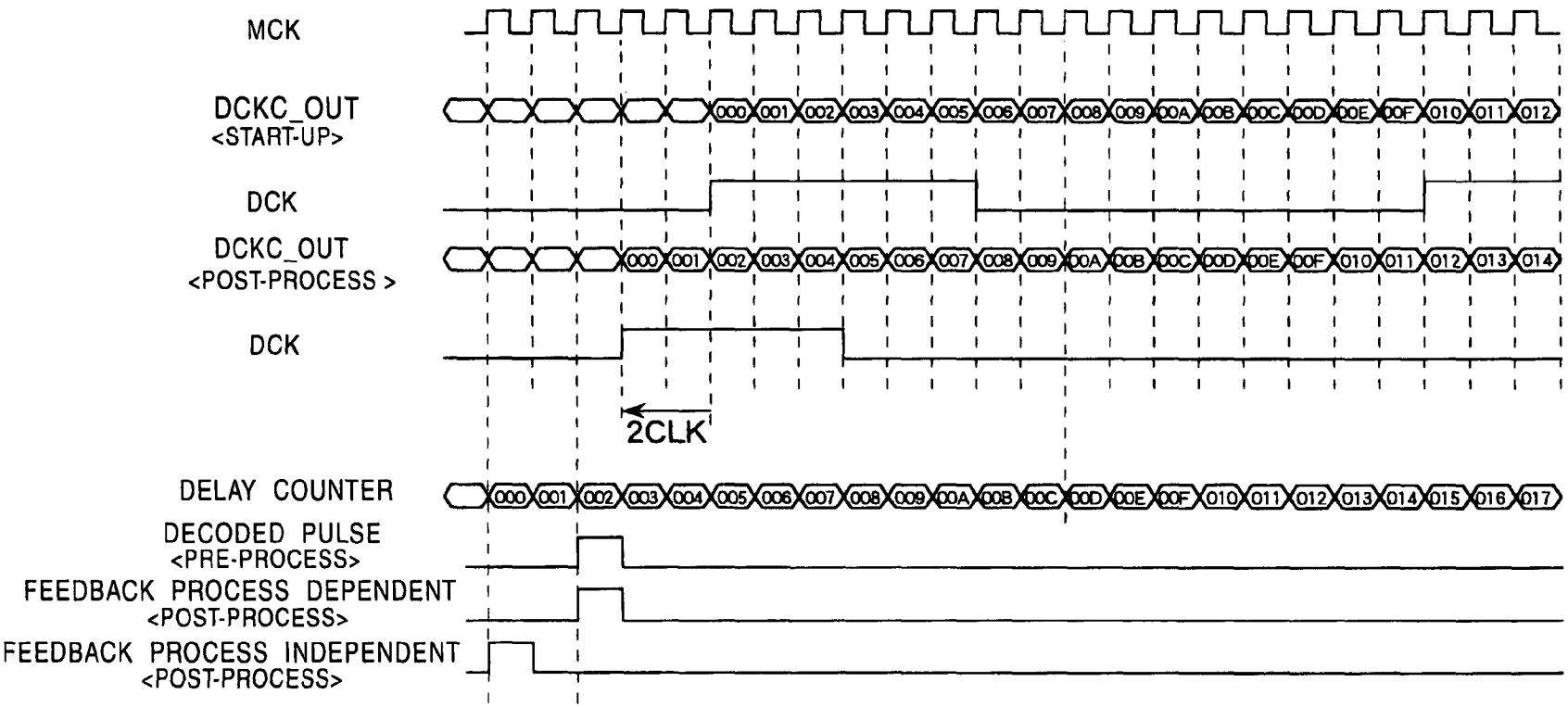
FIG. 7 is a timing diagram illustrating a circuit operation of the pulse generator.

When the scan pulse SOUT itself is fed back, the decode pulse decodes 000h in each of the RGB delay counters 19R, 19G, and 19B in the feedback process as shown in the timing diagram shown in FIG. 7. The count decoded from the startup phase is added. The decode pulse position is shifted forward from the reset position by that count.

The CPU (not shown) controlling the entire system sets information such as the register values SHP, HCKC, DCKC, DCKW, DFT_ON, and OFSET supplied to the HCK and DCK pulse generator, and the polarity setting values HCKPOL and DCKPOL.

The liquid-crystal display device of the preferred embodiment of present invention automatically adjusts the phase of the timing signals for multi-pixel simultaneous writing through the feedback process. The automatic phase adjustment process will now be discussed.

When the LCD panels 11R, 11G, and 11B are driven, the driving IC 21 receives the scan pulses R_SOUT, G_SOUT, and B_SOUT which are output from the LCD panels 11R, 11G, and 11B respectively through the shift registers 371 in the switch pulse generators 37 thereof. The processes of the scan pulses R_SOUT, G_SOUT, and B_SOUT are separately performed. For simplicity of the following discussion, the scan pulse SOUT represents the scan pulses R_SOUT, G_SOUT, and B_SOUT.

The edge detector 20 in the driving IC 21 detects the rising edge and the falling edge of the scan pulse SOUT as illustrated in FIG. 5. The edge detector 20 outputs the detected pulse, which is transitioned to a high level at the detection timing, as a decode pulse. Each of the RGB delay counters 19R, 19G, and 19B counts the horizontal position data HPC_OUT provided by the H position counter 41 (see FIG. 6) in the timing generator 16. The reset timings of the RGB delay counters 19R, 19G, and 19B are set to any values by reset data HPC_DAT.

The counts of the RGB delay counters 19R, 19G, and 19B are decoded by the RGB decoders 18R, 18G, and 18B in response to the R, G, and B detected pulses provided by the edge detector 20 serving as triggers. The decoded values of the RGB decoders 18R, 18G, and 18B are respectively the delay amounts (delay times) GDFT (R_GDFT, G_GDFT, and B_GDFT) from the optimum states of the scan pulses R_SOUT, G_SOUT, and B_SOUT, and are supplied to the feedback processing block 48 (see FIG. 6) in the timing generator 16.

The optimum state refers to a state in which the phase relationship between the timing signal for simultaneous writing and the video signal is optimized in the adjustment process prior to the shipment of the liquid-crystal display device. The phase relationship will change when the circuit elements such as transistors deteriorate in performance due to temperature cycles and aging after the shipment of the liquid-crystal display device.

The mode signal DFT_MODE input to the edge detector 20 determines whether to use the rising edge or the falling edge of each of the scan pulses R_SOUT, G_SOUT, and B_SOUT in the determination of the delay amounts GDFT (R_GDFT, G_GDFT, and B_GDFT). This determination may be performed based on the state of the LCD panels 11R, 11G, and 11B.

The HCK and DCK pulse generator illustrated in FIG. 6 performs the feedback process to account for the delay amounts GDFT (R_GDFT, G_GDFT, and B_GDFT) calculated as described above in the reset position (timing) of the DCK counter 43. More specifically, the decoder 45 decodes the horizontal position data HPC_OUT with respect to the delay amount GDFT, thereby generating the reset pulse DCK_RS to reset the DCK counter 43. The pulsewidth control clock pulse DCK generated based on the count of the DCK counter 43 is used as a sample-and-hold pulse for the parallel process in the LCD driver 12.

The liquid-crystal display device performs the feedback process in the multi-pixel simultaneous writing (six pixels at a time in this preferred embodiment). More specifically, the scan pulses R_SOUT, G_SOUT, and B_SOUT output from the LCD panels 11R, 11G, and 11B are input to the driving IC 21 which supplies the LCD panels 11R, 11G, and 11B with a variety of timing signals. The delay amounts (delay times) GDFT from the scan pulses R_SOUT, G_SOUT, and B_SOUT in the optimum states thereof are measured. The delay amounts are accounted for in the pulse for sampling and holding the video signal, such as the pulsewidth control clock pulse DCK. In this way, the phase relationship between the variety of timing signals for driving the LCD panels 11R, 11G, and 11B and the video signal is automatically adjusted to the optimum state.

Signal delay takes place in the driving pulses such as the switch pulses SPLS1, SPLS2, . . . when the circuit elements such as transistors in the LCD panels 11R, 11G, and 11B deteriorate due to temperature cycles and aging. As a result, a phase shift is created in the phase relationship between the driving pulses and the video signal. This phase shift is automatically corrected, and a disturbance in the video signal is thus removed. An optimum image is constantly presented without any effect of the temperature cycles and aging.

The above-referenced liquid-crystal display device of the preferred embodiment of the present invention receives the pulsewidth control clock pulses DCK1 and DCK2 from the outside. In the HCK and DCK pulse generator shown in FIG. 6, the pulsewidth and period of the pulsewidth control clock pulse DCK, and the phase difference with respect to the clock pulse determining the writing timing of the video signal to the pixels 31, namely, the horizontal clock pulse HCK are set to any values by the register values DCKC, DCKW, and DCKF. In the liquid-crystal display device of the type that generates the pulsewidth control clock pulses DCK1 and DCK2 in the panel using the horizontal clock pulses HCK and HCKX, the feedback process is equally performed inputting the pulsewidth control clock pulses DCK1 and DCK2 as the horizontal clock pulses HCK and HCKZ.

The liquid-crystal display device discussed above is of a multi-pixel simultaneous writing type. The present invention is not limited to the multi-pixel simultaneous writing type. Since the present invention relates to the technique that automatically adjusts the phase relationship between the video signal and the timing signal for writing the video signal, the present invention may be applied to the liquid-crystal display device that writes the video signal on a pixel-by-pixel basis.

The present invention is applied to the color liquid-crystal display device containing the LCD panels 11R, 11G, and 11B. The present invention is not limited to the color liquid-crystal display device. The present invention may be applied to a monochrome liquid-crystal display device. The present invention may also be applied to a display device such as an cathode-ray tube (CRT) or EL (Electroluminescent) display device, particularly a display device which writes a video signal on a plurality of pixels at a time.

Figure 8:
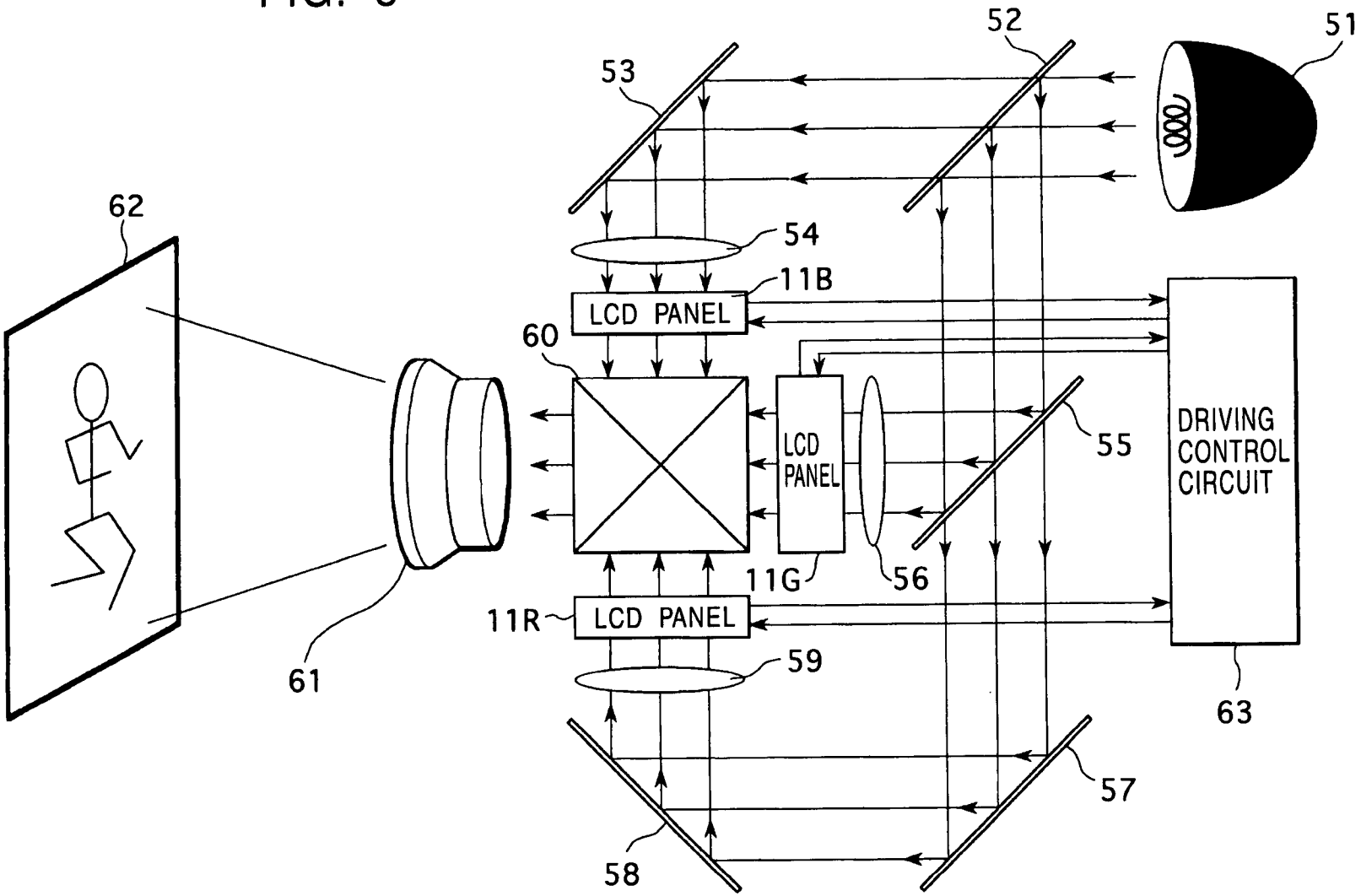
FIG. 8 illustrates a structure of a liquid-crystal projector.

The above-referenced driving IC 21 may be used as a signal processor for a projection-type liquid-crystal display apparatus. FIG. 8 illustrates such a projector.

As shown, a particular color component, such as the shortest wavelength blue (B) light component, of white light emitted from a light source 51 is transmitted through a first beam splitter 52, while the rest of the light is reflected from the first beam splitter 52. The blue light component transmitted through the first beam splitter 52 is reflected from a mirror 53 and is then incident on an LCD panel 11B after being transmitted through a lens 54.

A green (G) light component of the light reflected from the first beam splitter 52 is reflected from a second beam splitter 55, while a red (R) component of the light is transmitted through the second beam splitter 55. The green light component reflected from the second beam splitter 55 is incident on a G LCD panel 11G after being transmitted through a lens 56. The red light component transmitted through the second beam splitter 55 is reflected from mirrors 57 and 58, and is then incident on an R LCD panel 11R after being transmitted through a lens 59.

The R, G, and B light components respectively transmitted through the LCD panels 11R, 11G, and 11B are synthesized through a cross-prism 60. A synthesized light beam output from the cross-prism 60 is projected to a screen 62 through a projection prism 61.

When the LCD driver 12 performs the sample-and-hold process on the video signal in the liquid-crystal projector thus constructed, the analog video signals processed in parallel color by color by the signal processor shown in FIG. 1 are then parallel processed on a plurality of pixels, for example, six pixels, at a time. Each of the LCD panels 11R, 11G, and 11B receives the parallel processed video signal.

Each of the LCD panels 11R, 11G, and 11B receives a variety of driving pulses from a driving control circuit 63. The above-referenced driving IC 21, used as the driving control circuit 63, automatically corrects a shift in the phase relationship between the video signal and the driving pulse resulting from a delay of the driving pulse such as the switch pulse for the simultaneous writing taking place when the circuit elements such as transistors in the LCD panels 11R, 11G, and 11B deteriorate due to temperature cycles and aging. The video signal is thus free from any disturbance. An optimum image is constantly presented without any effect of the temperature cycles and aging.

The present invention is applied to the color liquid-crystal projector. Alternatively, the present invention may be applied to a monochrome liquid-crystal projector. The monochrome liquid-crystal projector requires only a single signal processing system.

What is claimed is:

1. A display device comprising:

a display having a matrix of pixels;

phase shift detector means for detecting the amount of phase shift of a writing signal for writing a video signal onto the pixel, the phase shift of the writing signal being caused as a result of the passage thereof through the display; and control means for adjusting the timing of the writing signal in a feedback process based on the phase shift amount detected by the phase shift detector means so that the phase shift amount becomes zero and wherein the writing signal is generated based on a timing signal that parallel processes the video signal in units of pixels, each unit including a plurality of pixels, and writes the video signal onto the pixels on a unit by unit basis, and wherein the control means adjusts the timing of the timing signal based on the phase shift amount detected by the phase shift detector means so that the phase shift amount becomes zero.

2. A display device according to claim 1, wherein the control means comprises a pulse generator for generating the timing signal in the form of a pulse signal, and sets the pulsewidth and the period of the pulse signal to any desired values.

3. A display device according to claim 2, wherein the pulse generator sets, to any desired value, a phase difference of the timing signal with respect to a clock pulse that determines the write timing of the video signal to the pixels.

4. A display device according to claim 1, wherein the phase shift detector means comprises a counter that determines a delay amount of the pulse signal serving as a reference for the writing signal, and a decoder that decodes a count of the counter in response to the output of the edge detector as a trigger.

5. A display device according to claim 1, wherein the control means adjusts the timing of the writing signal regardless of whether or not the pulse signal serving as a reference for the writing signal output by the display is feedback processed.

6. A display device according to claim 1, wherein the control means has a function to switch on and off the feedback process and imparts an offset, to a reset position of the writing signal during an off period of the feedback process, during an on period of the feedback process.

7. A method of controlling a display device having a display including a matrix of pixels, the method comprising the steps of:

detecting the amount of phase shift of a writing signal for writing a video signal onto the pixel, the phase shift of the writing signal being caused as a result of the passage thereof through the display; and adjusting the timing of the writing signal in a feedback vrocess based on the detected phase shift amount so that the phase shift amount becomes zero and wherein the writing signal is generated based on a timing signal that parallel processes the video signal in units of pixels, each unit including a plurality of pixels, and writes the video signal onto the pixels on a unit by unit basis, and wherein the adjusting step comprises adjusting the timing of the timing signal based on the phase shift amount detected in the detecting step so that the phase shift amount becomes zero.

8. A projection-type display apparatus comprising:

a display panel having a matrix of pixels;

phase shift detector means for detecting the amount of phase shift of a writing signal for writing a video signal onto the pixel, the phase shift of the writing signal being caused as a result of the passage thereof through the display panel; and control means for adjusting the timing of the writing signal in a feedback process based on the phase shift amount detected by the phase shift detector means so that the phase shift amount becomes zero;

wherein the writing signal is generated based on a timing signal that parallel processes the video signal in units of pixels, each unit including a plurality of pixels, and writes the video signal onto the pixels on a unit by unit basis, and wherein the control means adjusts the timing of the timing signal based on the phase shift amount detected by the phase shift detector means so that the phase shift amount becomes zero.

* * * * *